US010279868B2

(12) United States Patent
Matney

(10) Patent No.: US 10,279,868 B2
(45) Date of Patent: May 7, 2019

(54) SHROUD FOR WATER VESSELS

(71) Applicant: Billy W. Matney, Greensburg, KY (US)

(72) Inventor: Billy W. Matney, Greensburg, KY (US)

(73) Assignee: Billy W. Matney, Greensburg, KY (US)

( * ) Notice: Subject to any disclaimer, the term of this patent is extended or adjusted under 35 U.S.C. 154(b) by 0 days.

(21) Appl. No.: 15/646,870

(22) Filed: Jul. 11, 2017

(65) Prior Publication Data

US 2019/0016416 A1 Jan. 17, 2019

(51) Int. Cl.
*B63B 7/08* (2006.01)
*B63C 9/04* (2006.01)

(52) U.S. Cl.
CPC ..... *B63B 7/085* (2013.01); *B63C 9/04* (2013.01); *B63C 2009/042* (2013.01)

(58) Field of Classification Search
CPC ..... B63B 7/085; B63C 9/04; B63C 2009/042
USPC ..... 441/66, 67; 114/361
See application file for complete search history.

(56) References Cited

U.S. PATENT DOCUMENTS 5,006,087 A * 4/1991 Peterson ..... B63B 7/08 114/345
6,648,707 B1 * 11/2003 Peterson ..... B63B 7/085 114/345
7,021,233 B2 * 4/2006 Hall ..... B63B 7/08 114/345
2012/0058696 A1 * 3/2012 Whitman ..... B62B 15/006 441/66

OTHER PUBLICATIONS

Heather Francis, "Protecting Your Inflatable" Cruising World, posted Mar. 22, 2017 at 10:39am; Retrieved by examiner Jul. 31, 2018 (Year: 2017).*

* cited by examiner

*Primary Examiner* — Anthony D Wiest
(74) *Attorney, Agent, or Firm* — Middleton Reutlinger

(57) ABSTRACT

Shrouds for water vessels are described herein. In various embodiments, a shroud may include port, starboard, and bow surfaces that are contoured to an outer periphery of one or more inflatable tube portions of an inflatable raft. The shroud may also include a bottom surface from which at least the port side surface and starboard side surface extend upwardly. The shroud may define an interior cavity that is bounded by the port side surface, a starboard side surface, and the bow surface. The interior cavity may be sized and shaped to removably receive the inflatable raft. In some embodiments in which the shroud is secured to a self-bailing raft, the shroud may obstruct one or more fore self-bailing ports of the self-bailing inflatable raft and leave one or more aft self-bailing ports of the self-bailing inflatable raft unobstructed.

16 Claims, 12 Drawing Sheets

SHROUD FOR WATER VESSELS

BACKGROUND

Inflatable rafts are used in a variety of settings, and are sometimes referred to as "inflatable dinghy's," "rubber dinghy's," "inflatable rescue boats," and boats sold under the brand Zodiac®. Some inflatable rafts are "self-bailing" in that they include ports or apertures at various locations that allow for water to enter into, and then be discharged from, the vessel. Inflatable rafts (self-bailing or otherwise) are often constructed with materials such as rubber, polyvinyl chloride, chlorosulfonated polyethylene (CP), para-aramid synthetic fiber (e.g., Kevlar®), and so forth. While inflatable rafts are well-suited for outdoor activities such as fishing, white water rafting (for which self-bailing rafts are particularly suitable), etc., they are less suited for a variety of other applications, particularly rescue-related activities, for various reasons.

In swift water rescues (e.g., caused by flash floods, dam/levy failures, etc.), a water vessel may be launched upstream from individuals in need of rescue and allowed to drift downstream towards the endangered individuals. In most cases a rope or cable ("rigging line") may be secured to the vessel's bow (e.g., using a D-ring or other similar hardware) from the launch point, so that the bow (or simply one side of a symmetric raft) remains pointed upstream as the current carries the vessel downstream. If a conventional self-bailing inflatable raft is used in such a scenario, the downstream current (which may be moving downstream faster than the raft) may cause the raft to take on water so quickly that its self-bailing mechanisms are unable to keep up, causing the raft to sink or be swamped. In particular, fore self-bailing ports (i.e. ports towards the front of the raft) may take on water more quickly than aft ejection ports towards the raft's stern are able to discharge the water. In some cases, inflow from fore self-bailing ports may exceed 10-12 cubic feet of water. This may cause excessive force to be applied to the rigging line and/or to anchors on the raft to which the rigging line is secured.

Additionally, in swift water rescues and/or in other rescue scenarios, such as floods, there may be substantial debris, or "top load," at or near the surface of the water that can damage an inflatable raft. Additionally, in flood situations, various objects such as street signs, mailboxes, fences, vehicles, etc., may be submerged and thus not visible to passengers of a vessel. These unseen objects are capable of causing significant damage to, and potentially sinking, an inflatable raft.

SUMMARY

In various embodiments, a shroud for a self-bailing inflatable raft may include: a port side surface that is contoured to an outer periphery of a port inflatable tube portion of the self-bailing inflatable raft; a starboard side surface that is contoured to an outer periphery of a starboard inflatable tube portion of the self-bailing inflatable raft; a bow surface extending between the port side surface and the starboard side surface, wherein the bow surface is contoured to an outer periphery of a bow inflatable tube portion of the self-bailing inflatable raft; a bottom surface from which at least the port side surface and starboard side surface extend upwardly; and an interior cavity bounded by the port side surface, a starboard side surface, and the bow surface, wherein the interior cavity is sized and shaped to removably receive the self-bailing inflatable raft such that the shroud obstructs one or more fore self-bailing ports of the self-bailing inflatable raft and leaves one or more aft self-bailing ports of the self-bailing inflatable raft unobstructed.

In various embodiments, the shroud may include a fore section and an aft section that are permanently affixed together and that are constructed using different materials. In various embodiments, the fore section may obstruct the one or more fore self-bailing ports and the aft section defines one or more ejection apertures at one or more positions on the shroud that align with the one or more aft self-bailing ports of the self-bailing inflatable raft. In various embodiments, the one or more ejection apertures may be defined in the bottom surface of the shroud.

In various embodiments, the fore section of the shroud may be more rigid than the aft section of the shroud. In various embodiments, the fore section of the shroud is constructed with high density polyethylene. In various embodiments, the fore section of the shroud is between about $1/10^{th}$ inch and about $1/6^{th}$ inch thick. In various embodiments, the aft section of the shroud may be constructed with a flexible para-aramid synthetic fiber.

In various embodiments, the fore section may comprise over half of the shroud extending from the bow surface. In various embodiments, one or more anchor apertures may be defined in one or more of the port side, starboard side, and bow side surfaces to provide access through the shroud to one or more anchor points of the self-bailing inflatable raft. In various embodiments, the shroud may be constructed entirely with a flexible para-aramid synthetic fiber.

In another aspect, A textile shroud for a self-bailing inflatable raft may include: a port side portion that is sized and shaped to be wrapped at least partially around an outer periphery of a port inflatable tube portion of the self-bailing inflatable raft; a starboard side portion that is sized and shaped to be wrapped at least partially around an outer periphery of a starboard inflatable tube portion of the self-bailing inflatable raft; a bow portion extending between the port side portion and the starboard side portion, wherein the bow portion is sized and shaped to be wrapped at least partially around an outer periphery of a bow inflatable tube portion of the self-bailing inflatable raft; and a bottom portion extending transversely between the port side, starboard side, and bow portions and including one or more ejection apertures; wherein upon wrapping the port side, starboard side, and bow portions at least partially around the port inflatable tube, starboard inflatable tube, and bow inflatable tube portions, respectively, the shroud obstructs one or more fore self-bailing ports of the self-bailing inflatable raft and the one or more ejection apertures align with one or more aft self-bailing ports of the self-bailing inflatable raft.

In yet another aspect, a shroud for an inflatable raft may include: a port side surface that is contoured to an outer periphery of a port inflatable tube portion of the inflatable raft; a starboard side surface that is contoured to an outer periphery of a starboard inflatable tube portion of the inflatable raft; a bow surface extending between the port side surface and the starboard side surface, wherein the bow surface is contoured to an outer periphery of a bow inflatable tube portion of the inflatable raft; a stern surface extending between the port side surface and the starboard side surface approximately parallel to the bow surface, wherein the stern surface is contoured to an outer periphery of a stern inflatable tube portion of the inflatable raft; a bottom surface from which the port side surface, starboard side surface, bow surface, and stern surface extend upwardly; and an interior cavity bounded by the port side surface, a starboard side surface, the bow surface, and the stern surface, wherein the interior cavity is sized and shaped to removably receive the inflatable raft such that one or more anchor points of the inflatable raft extend through one or more apertures defined in the shroud.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of embodiments of the invention.

DETAILED DESCRIPTION

Figure 1:
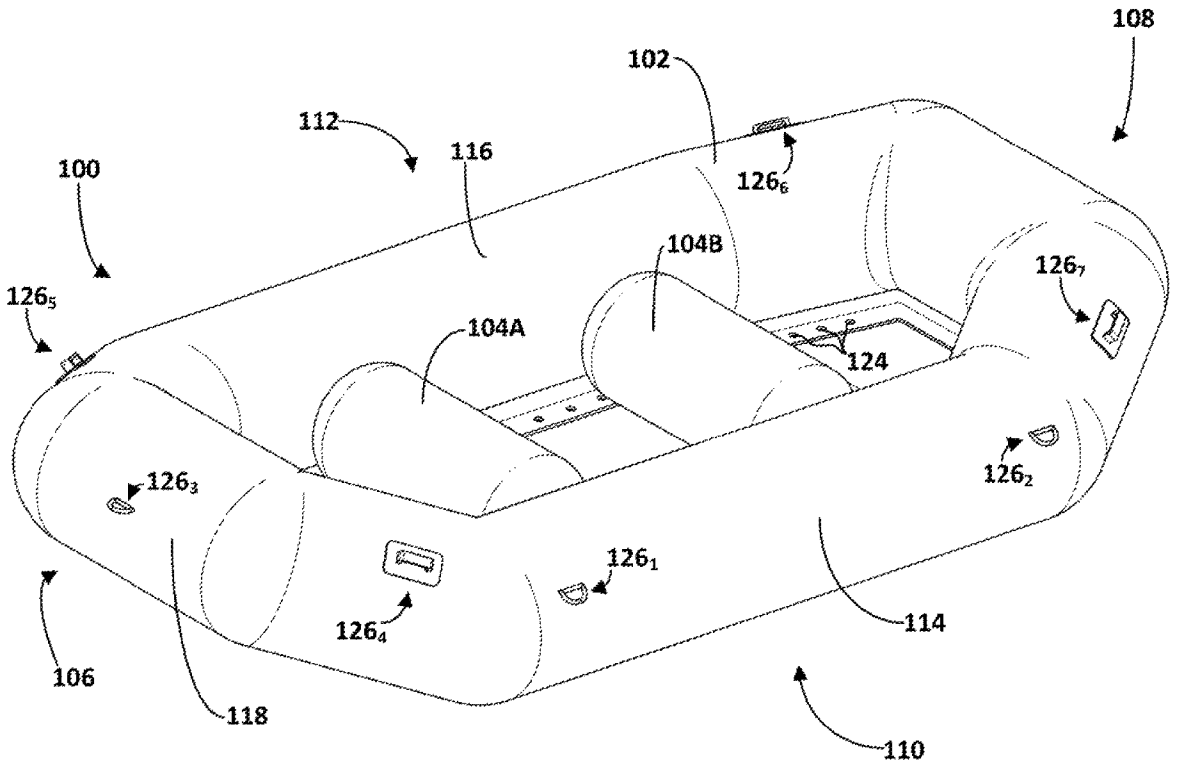
Fig. 1 (Prior Art)
FIGS. 1 and 2 are perspective views of a self-bailing inflatable raft in accordance with the prior art.
Figure 2:
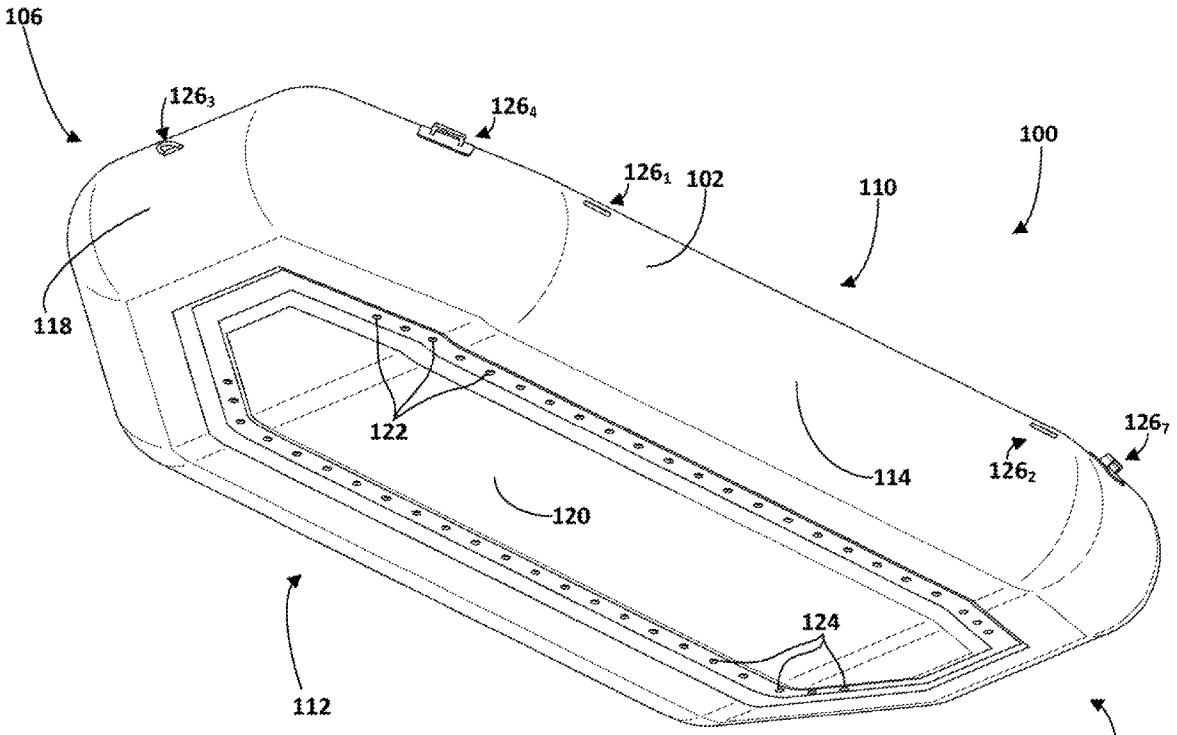
Fig. 2 (Prior Art)

Referring now to FIGS. 1 and 2, a conventional self-bailing inflatable raft 100 is depicted. In this particular example, raft 100 includes a peripheral inflatable tube 102 and two transverse inflatable tubes 104A and 104B. However, this is not meant to be limiting. Conventional self-bailing inflatable rafts may come in a variety of configurations that include various numbers of distinct inflatable tubes. As is the case with most boats, self-bailing raft 100 includes a bow 106, a stern 108, a port side 110, and a starboard side 112. For purposes of this disclosure, a port inflatable tube portion is indicated generally at 114, a starboard inflatable tube portion is indicated at 116, and a bow inflatable tube portion is indicated at 118. While portions 114-118 are all integral part of peripheral inflatable tube 102 that forms the entire perimeter of raft 100, this is not meant to be limiting. In other embodiments, portions 114-118 may be distributed amongst multiple distinct inflatable tubes. Raft 100 also includes a bottom 120 (visible in FIG. 2) that extends underneath transverse inflatable tubes 104A and 104B between opposite ends of peripheral inflatable tube 102. Raft 100 depicted herein is symmetrical from bow 106 to stern 108. However, this is not meant to be limiting. Some inflatable rafts (self-bailing or otherwise) may not be symmetrical, and instead may include sterns that vary greatly from their bows.

In order to be "self-bailing," raft 100 includes a number of self-bailing ports, including one or more fore self-bailing ports 122 and one or more aft self-bailing ports 124 (seen best in FIG. 2). Fore self-bailing ports 122 may be positioned towards bow 106 and may be configured to take in water. Aft self-bailing ports 124 may be positioned towards stern 108 and may be configured to discharge water that enters raft 100 through fore self-bailing ports 122. As noted above, in some cases, including the embodiment depicted in FIGS. 1 and 2, raft 100 may be roughly symmetric from bow 106 to stern 108. Accordingly, if raft 100 is propelled backwards in water, fore self-bailing ports 122 may serve to discharge water that enters raft 100 through aft self-bailing ports 124. Similarly, if raft is travelling in a direction that is perpendicular to its length, both fore self-bailing ports 122 and aft self-bailing ports 124 on one side (e.g., port side 110) may act as intake ports, and both fore self-bailing ports 122 and aft self-bailing ports 124 on the other side (e.g., starboard side 112) may act as discharge ports.

Raft 100 may include various hardware that may be used for a variety of purposes. One or more anchor points $\mathbf{126}_{1\text{-}8}$, such as D-rings, loops, handles, hooks, etc., may be positioned at various positions on peripheral inflatable tube 102. Some anchor points, such as first anchor point $\mathbf{126}_1$ and second anchor point $\mathbf{126}_2$, which in FIG. 1 are D-rings, may be positioned on port side 110. Similar anchor points (not visible in FIG. 4) may be positioned on starboard side 112. Other anchor points such as anchor point $\mathbf{126}_3$ (also a D-ring in FIG. 1) may be positioned at bow 106 and/or at stern 108, respectively, and may be used, for instance, to secure rigging line (e.g., rope, cable, chain, etc.) to raft 100 for various purposes. Yet other anchor points, such as handles $\mathbf{126}_{4\text{-}7}$, may be used to carry raft 100 while raft is not in the water. A stern anchor point $\mathbf{126}_8$ in the form of a D-ring is depicted in FIGS. 6-8 and 11.

One purpose for which rigging lines may be secured to anchor points such as $\mathbf{126}_3$ may be a swift water rescue. When individual(s) are trapped in a high-current channel or other flow of water, e.g., clinging from trees, partially submerged vehicles, or unsubmerged mini islands, a rescue boat may be launched upstream from them and then allowed to drift downstream to the individual(s). Rigging line may be secured to a bow anchor point (e.g., D-ring) so that rescuers at the launch point can slowly feed out rigging line to allow the vessel to drift with the current downstream towards the individual(s) in need of rescue. Because the vessel is secured at its bow, the vessel will drift downstream with its bow facing upstream and its stern facing downstream.

Figure 3:
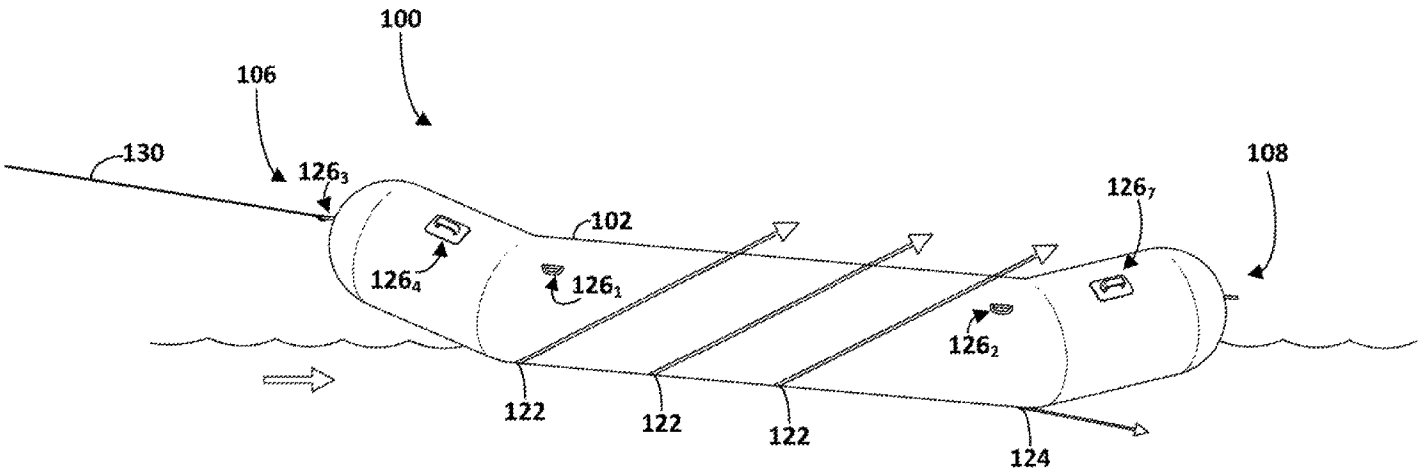
Fig. 3 (Prior Art)
FIG. 3 demonstrates at least some shortcomings of using a conventional self-bailing raft in a swift water rescue.

Non-self-bailing vessels, often with rigid bottoms, are typically used for such swift water rescues. Conventional inflatable rafts—including self-bailing rafts such as raft 100—are usually avoided because they are vulnerable to top load and/or submerged obstacles. Self-bailing inflatable rafts present an additional challenge. In FIG. 3, conventional raft 100 is secured to a point upstream (not depicted) by rigging line 130. Current flows downstream (to the right in FIG. 3). As shown by the relative sizes of the various diagonal arrows, the fore self-bailing ports 122 acting as intake ports may allow water into raft 100 more quickly than aft self-bailing ports 124 acting as discharge ports are able to discharge the water. This results in raft 100 becoming swamped and/or submerged, and can place tremendous pressure on rigging line 130 and/or on anchor points (e.g., $\mathbf{126}_3$) to which rigging line 130 is secured.

Figure 4:
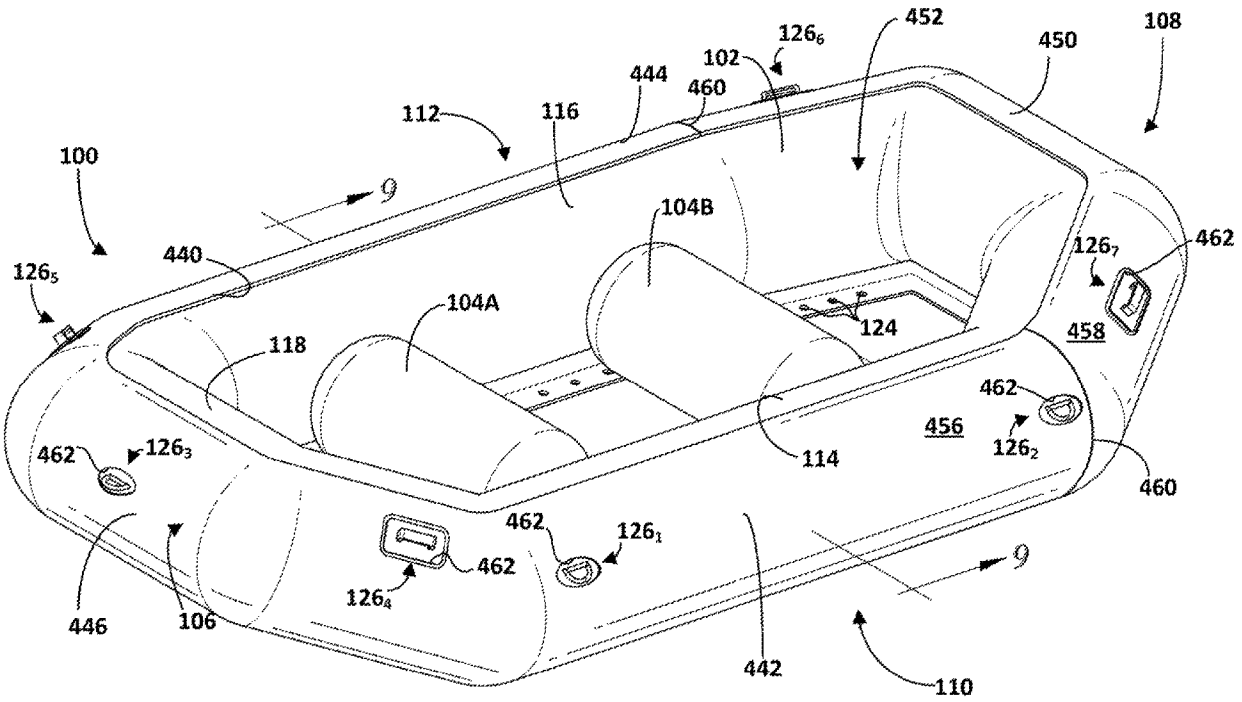
FIG. 4 depicts a first embodiment of a shroud configured with selected aspects of the present disclosure, in accordance with various embodiments.
Figure 5:
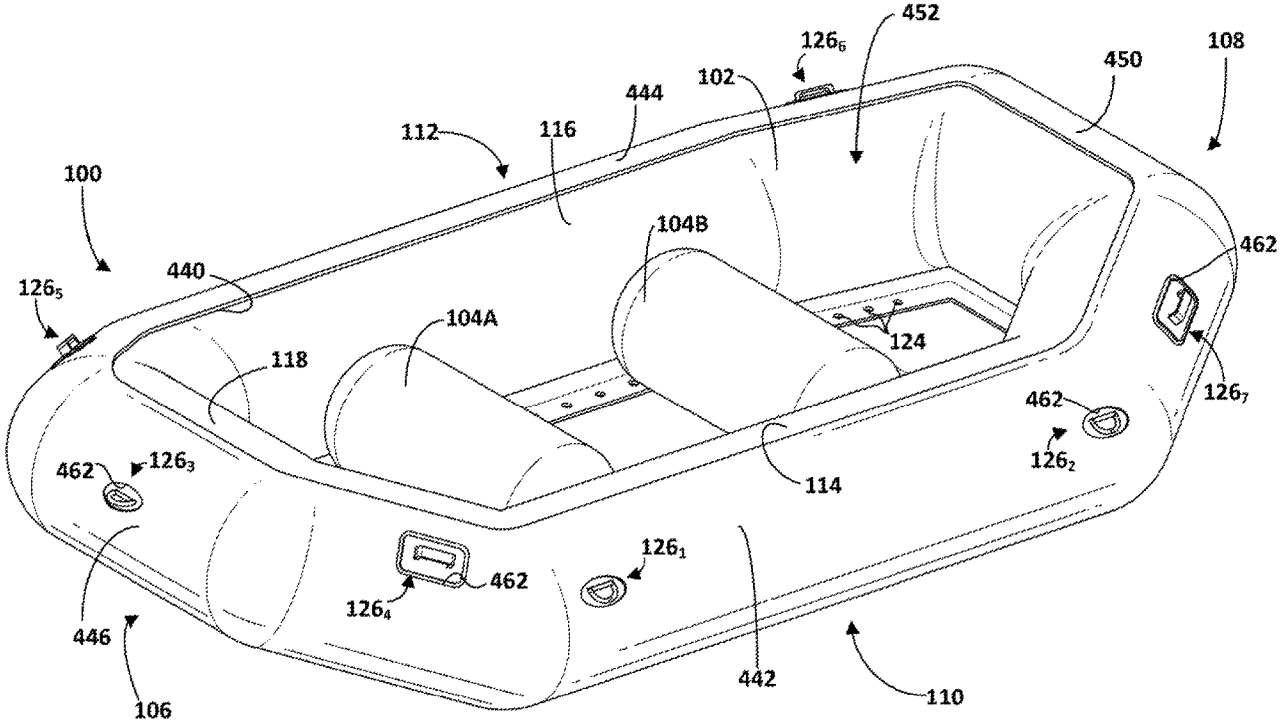
FIG. 5 depicts a second embodiment of a shroud configured with selected aspects of the present disclosure, in accordance with various embodiments.
Figure 6:
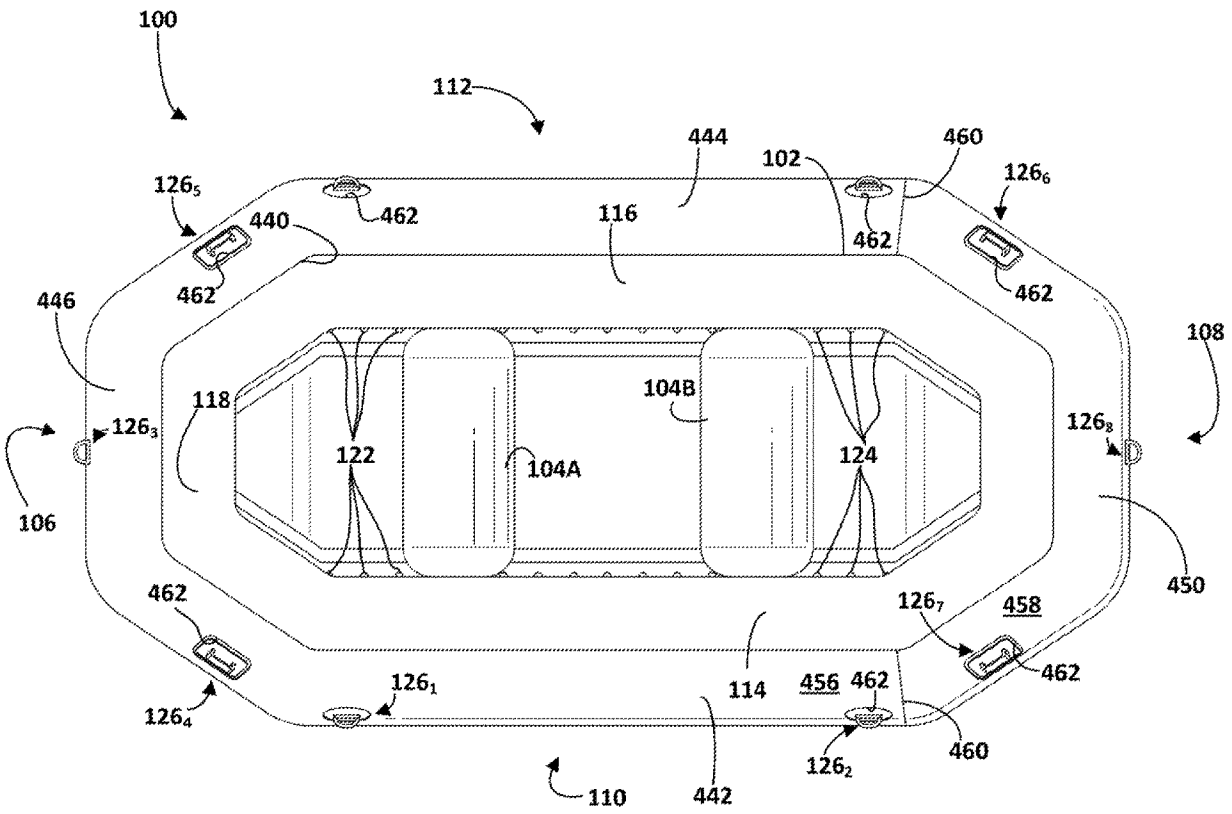
FIGS. 6, 7, 8, 9, and 10 depict top, bottom, profile, cross-sectional, and front views, respectively, of the embodiment of FIG. 4.

Accordingly, various embodiments are described herein for shrouds that can be secured to inflatable rafts, such as self-bailing inflatable rafts and non-self-bailing inflatable rafts, so that the rafts are less vulnerable to these risks and can be used in various rescue situations. Self-bailing rafts in particular may still function as self-bailing rafts when equipped with some embodiments of the shroud described herein. FIG. 4 depicts a perspective view of a shroud 440 configured with selected aspects of the present disclosure. Shroud 440 is depicted affixed to the conventional self-bailing inflatable raft 100 of FIGS. 1-3. FIG. 5 depicts a slight variation of the embodiment of FIG. 4. FIGS. 6, 7, 8, 9, and 10 depict the embodiment of FIG. 4 from top down, bottom, side profile, cross-sectional, and front, respectively.

In various embodiments, shroud 440 may include a port side surface 442, a starboard side surface 444, a bow surface 446 that extends between port side surface 442 and starboard side surface 444, and a bottom surface 448 (see FIG. 7) from which at least port side surface 442 and starboard side surface 444 extend upwardly. In some embodiments, shroud 440 may also include a stern surface 450 that extends between port side surface 442 and starboard side surface 444, e.g., approximately parallel to bow surface 446. In other embodiments, stern surface 450 may be omitted and a rear portion of raft 100 may be left exposed.

Figure 9:
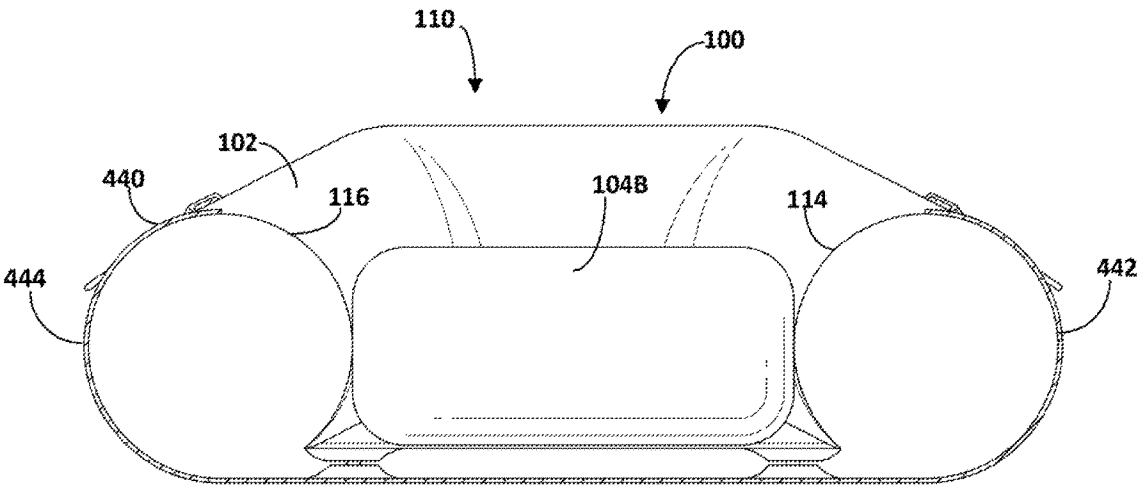
Figure 10:
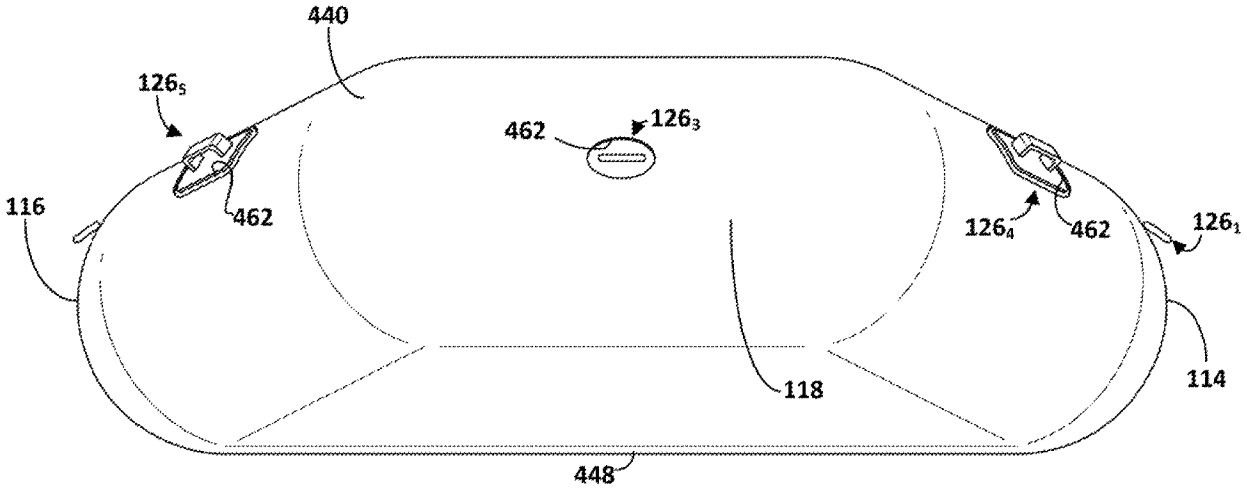

In some embodiments, and as is best seen in FIG. 9, port side surface 442 may be contoured (e.g., molded, shaped, form-fitted, etc.) to an outer periphery of port inflatable tube portion 114 of self-bailing inflatable raft 100. Similarly, starboard side surface 444 may be contoured to an outer periphery of starboard inflatable tube portion 116 of raft 100, and bow surface 446 may be contoured to an outer periphery of bow inflatable tube portion 118 of raft 100. Shroud 440 may also include (e.g., define) an interior cavity 452 bounded by port side surface 442, starboard side surface 444, bow surface 446, bottom surface 448, and when present, stern surface 450. In some embodiments, shroud 440, including surfaces 442-450, may formed (e.g., molded) as a single unitary piece into which raft 100 may be fitted.

In various embodiments, interior cavity 452 may be sized and shaped to removably receive self-bailing inflatable raft 100 such that shroud 440 obstructs one or more fore self-bailing ports 122 of raft 100 and leaves one or more aft self-bailing ports 124 unobstructed. For example, in FIG. 7, in which bottom surface 448 of shroud 440 is visible, two ejection apertures 454 are defined through bottom surface 448 such that when shroud 440 is secured to raft 100, ejection apertures 454 are aligned with two aft self-bailing ports 124, leaving them unobstructed. This may permit water that accumulates within raft 100 to be discharged from stern 108 of raft 100. Meanwhile, shroud 440 does not include similar openings towards bow 106. Accordingly, fore self-bailing ports 122 are obstructed, preventing excessive amounts of water from entering raft 100.

Figure 11:
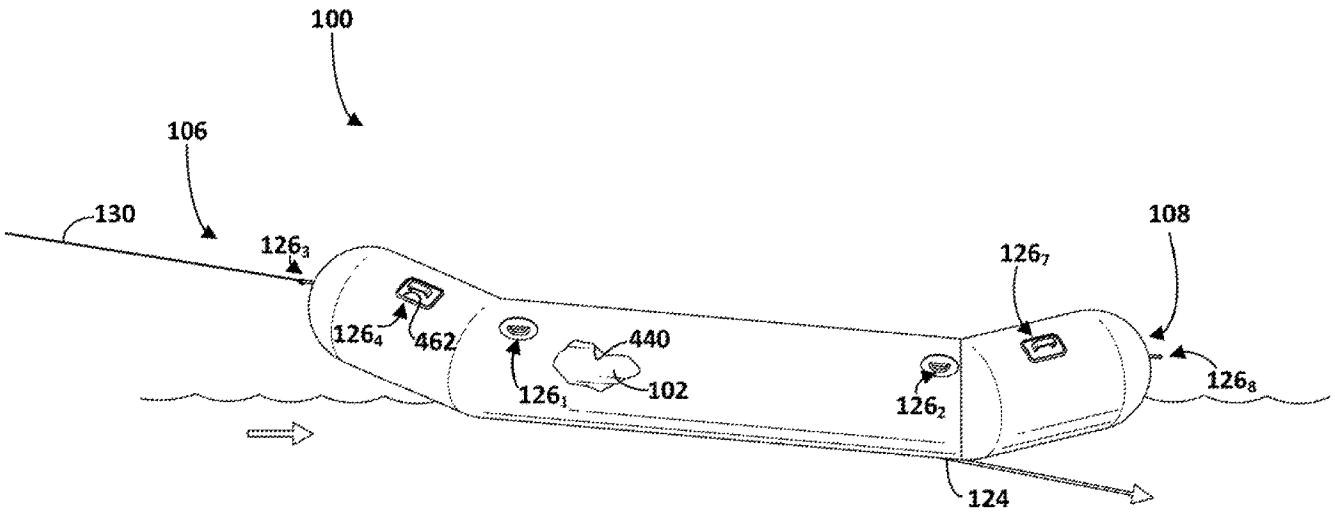
FIG. 11 demonstrates how a shroud configured with selected aspects of the present disclosure may overcome some of the shortcomings depicted in FIG. 3.

An example of this is depicted in FIG. 11, which is similar to FIG. 3 except that raft 100 in FIG. 11 is equipped with a shroud 440 configured with selected aspects of the present disclosure. Otherwise, raft 100 once again is secured with rigging line 130 to a point/person(s) upstream (not depicted). In FIG. 11, it can be seen that although the same current is present (represented by the horizontal arrow), no water is permitted into raft 100 through fore self-bailing ports 122, while any water that happens to accumulate in raft 100, e.g., by way of rain, overspray, standing waves, etc., is discharged from stern 108 through aft self-bailing ports 124. Consequently, raft 100 remains steady and relatively unswamped while being allowed to drift downstream towards its target. While the examples depicted herein have only shown a single rigging line 130 attached to raft 100 at a single point, this is not meant to be limiting. In various embodiments, one or more rigging lines 130 may be secured to raft 100 at multiple points, such as at anchor points $\mathbf{126}_{3\text{-}5}$, or at even more anchor points as desired.

Shroud 440 may be constructed with a variety of different materials so that it has various levels of rigidity/flexibility. In some embodiments in which it is desired that shroud 440 be relatively rigid, shroud 440 may be constructed at least in part with high density polyethylene, such as ultra-high-molecular-weight polyethylene ("UHMW"). For example, shroud 440 may be constructed from one or more sheets of heavy plastic that may be configurable between a compact arrangement, e.g., rolled up or folded up, and an expanded arrangement in which shroud 440 may be secured to self-bailing inflatable raft 100. In some embodiments, more flexible materials may be employed, such as flexible para-aramid synthetic fiber (e.g., Kevlar®). Shroud 440 may be constructed at various thicknesses across its entirety and/or in individual portions, depending on the desire for rigidness, flexibility, protection from debris, etc. In some embodiments, shroud 440 may be between about $1/10^{th}$ of an inch and $1/6^{th}$ of an inch thick, such as $1/8^{th}$ thick of an inch at some or all portions. Other thicknesses are possible. In some embodiments, shroud 440 may weigh between approximately eight and twenty-five lbs. In some embodiments, shroud 440 may be constructed to be sufficiently rigid that, in the event one or more inflatable tubes of raft 100 are deflated, shroud 440 may aide in maintaining raft's shape.

In some embodiments, shroud 440 may be constructed with different materials at different portions. For example, in FIGS. 4 and 6-10, shroud 440 is divided into a fore section 456 and an aft section 458 (at seam 460) that are permanently affixed together and that are constructed using different materials. For example, fore section 456 may be constructed to be relatively rigid compared to aft section 458, e.g., so that fore section 456 may protect the front of raft 100 from floating and/or stationary debris. Meanwhile, aft section 458 may be relatively flexible to, for instance, allow stern 108 to be selectively raised out of and/or dropped into the current, e.g., to permit bailing during torrential conditions. In some embodiments, fore section 456 may be constructed with high density polyethylene and aft section 458 may be constructed with flexible para-aramid synthetic fiber. In other embodiments, the reverse may be true. Of course, other combinations of materials are possible; these are just examples.

FIG. 5 depicts an alternative embodiment in which the entirety of shroud 440 is uniformly constructed with the same material, which may be flexible para-aramid synthetic fiber, high density polyethylene, etc. Suppose shroud 440 is FIG. 5 is constructed entirely with flexible para-aramid synthetic fiber. That would mean it is not necessarily form-fitted to raft 100. However, it still operates in a similar fashion. In FIG. 5, port side portion 442 may be sized and shaped to be wrapped at least partially around an outer periphery of port inflatable tube portion 114. Starboard side portion 444 may be sized and shaped to be wrapped at least partially around an outer periphery of starboard inflatable tube portion 116. Bow portion 446 may extend between the port side portion 442 and starboard side portion 444. In various embodiments, bow portion 446 may be sized and shaped to be wrapped at least partially around an outer periphery of bow inflatable tube portion 118. While not visible in FIG. 5, a bottom portion may extend transversely between port side portion 442, starboard side portion 444, and bow portion 446, and may or may not include one or more ejection apertures. In some embodiments, shroud 440 of FIG. 5, when constructed with flexible para-aramid synthetic fiber, may include one or more ribs or other structural components that are, for instance, sewn into the textile. These structural components may be contoured to the outer periphery of peripheral inflatable tube 102, e.g., so that even flexible para-aramid synthetic fiber shroud 440 is form-fitted to raft 100.

Another feature of note are apertures that may be defined in shroud 440 to provide access through shroud 440 to one or more anchor points of self-bailing inflatable raft 100. Depending on the location of hardware (e.g., anchor points) on raft 100, these apertures may be defined at various locations, such as in one or more of port side surface 442, starboard side surface 444, bow surface 446, stern surface 450, and so forth. For example, in the figures, apertures are designated at 462 and allow outside access to various anchor points, including $\mathbf{126}_{1\text{-}8}$.

In various implementations, shroud 440 may be contoured to and extend around outer peripher(ies) of inflatable tubes (e.g., 102) of raft 100 to various degrees. In FIG. 9 (which is shown in cross-section from the line depicted in FIG. 4), for instance, it can be seen that shroud 440 extends around peripheral inflatable tube 102 to a point approximately at a top apex of peripheral inflatable tube 102. In other embodiments, shroud 440 may extend farther around peripheral inflatable tube 102 or less far around peripheral inflatable tube 102. In some embodiments, e.g., in which shroud 440 extends less far around peripheral inflatable tube 102, shroud 440 may be secured to one or more anchor points of raft 100 using rope, line, rigging line, etc., e.g., so that shroud 440 does not become dislodged from raft 100. In yet other embodiments, various types of rigging (e.g., nylon ropes or straps) may be secured to various apertures and/or hardware (not depicted) of shroud 440 itself, and may be wrapped across a top of raft 100 to corresponding hardware on another side of shroud 440.

Figure 7:
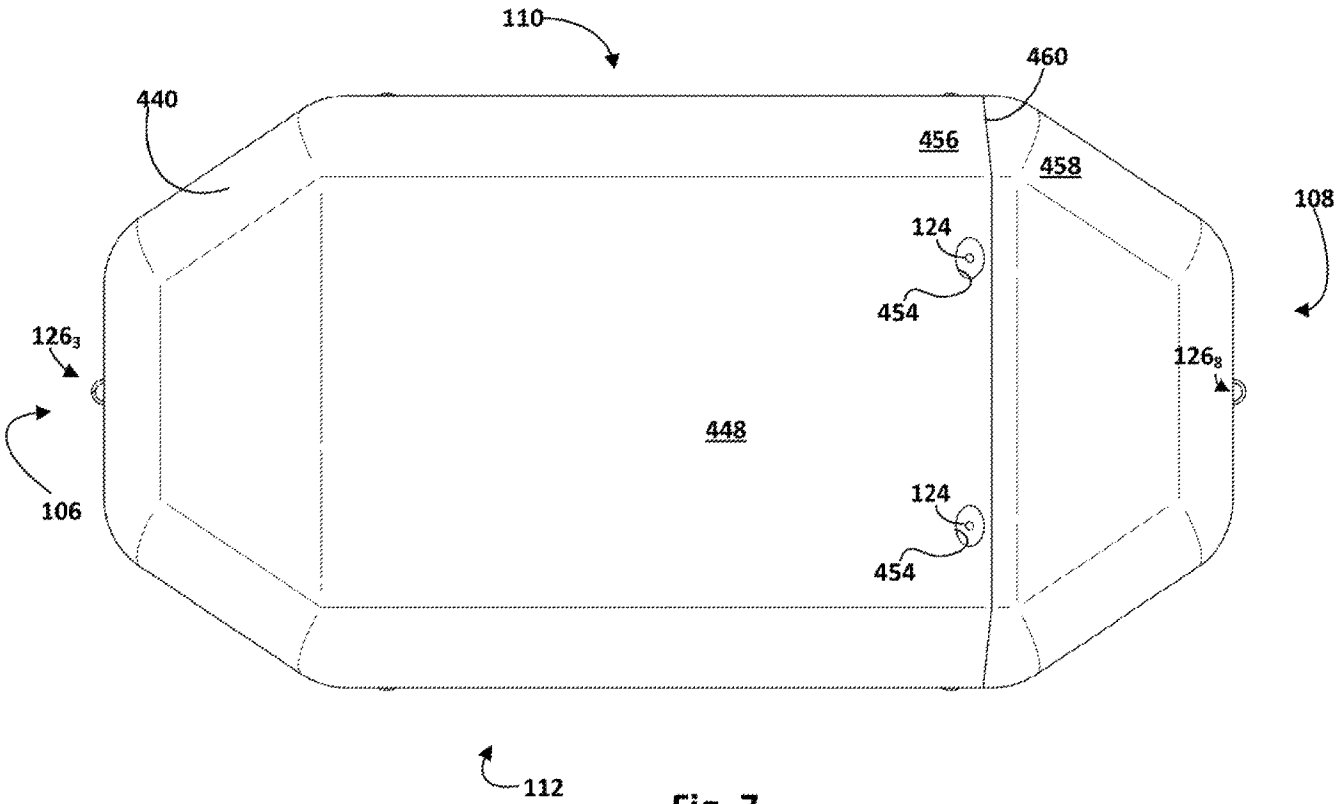
Figure 8:
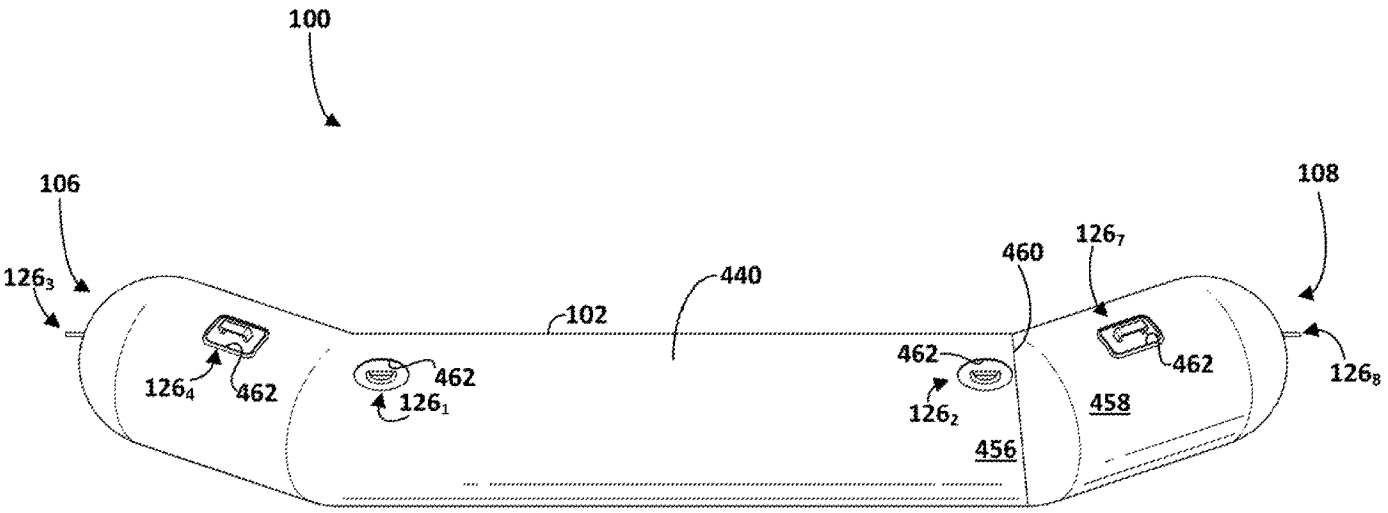
Figure 12:
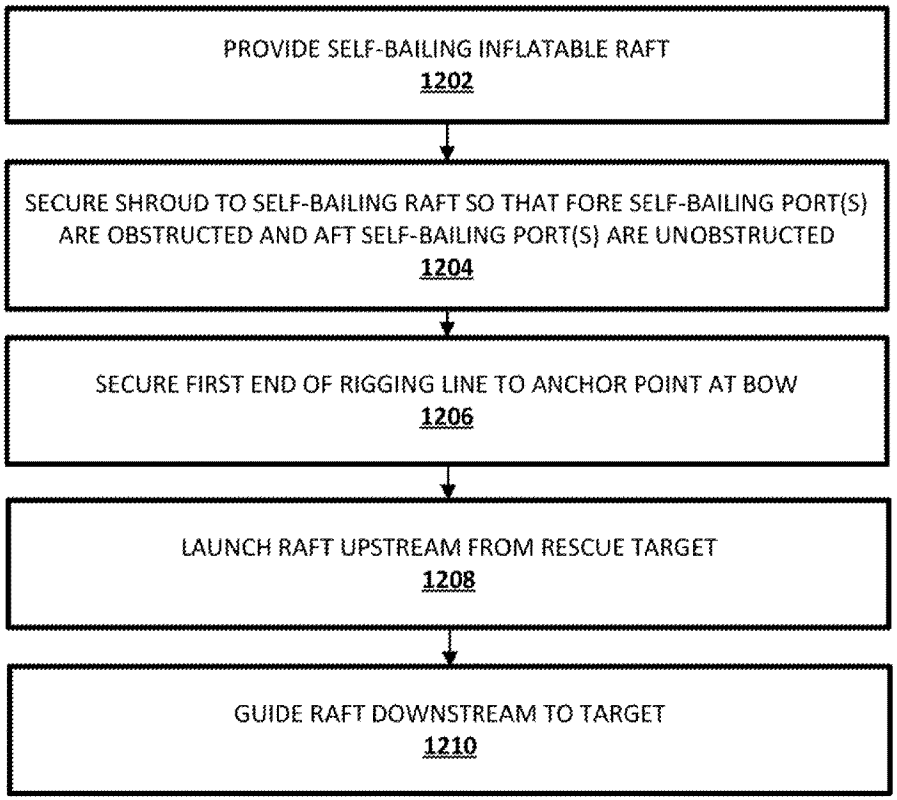
FIG. 12 depicts an example method of practicing selected aspects of the present disclosure, in accordance with various embodiments.

FIG. 12 depicts an example method for using a shroud configured with selected aspects of the present disclosure. At block 1202, a self-bailing inflatable raft (e.g., 100) may be provided. At block 1204, a shroud configured with selected aspects of the present disclosure may be secured to the raft so that fore self-bailing ports are obstructed and aft self-bailing ports remain unobstructed. While FIG. 7 depicted two ejection apertures 454, this is not meant to be limiting. In other embodiments, more or less ejection apertures 454 may be provided. In some embodiments, shroud 440 may be tailor-made for a particular type of self-bailing inflatable raft, in which case positions of the ejection apertures may be selected based on positions of discharge ports of the raft. In some embodiments, the raft may be inflated outside of shroud and then inserted into cavity 452. In other embodiments, the raft may be placed within cavity 452 first and then inflated, e.g., so that it expands against inner surface(s) of shroud 440.

At block 1206, a first end of rigging line (e.g., rope, nylon rope, nylon straps, chain, etc.) may be secured to an anchor port at one end of the raft, e.g., at anchor point $\mathbf{126}_3$ in FIG. 4. In other embodiments, the rigging line may be secured to more anchor points. At block 1208, the raft may be launched upstream from a rescue target (e.g., individual(s) trapped in moving current). In some cases, one or more rescue personnel may be deployed in the raft, although this is not required. At block 1210, the raft may be guided, e.g., by one or more rescue personnel at the launch point, to the rescue target. Once the raft reaches the rescue target, the individuals in need of rescue may board the raft and may, for instance be lowered farther downstream, e.g., to a point of safety. Additionally or alternatively, because the shroud offers protection from the raft being overfilled via fore self-bailing ports, the raft may be pulled upstream, e.g., towards the launch point. All the while, the bow of the raft may remain pointed upstream and water may be discharged more quickly than it accumulates in the raft.

In the examples described above, shroud 440 has included various mechanisms, such as ejection apertures 454, which enable self-bailing inflatable rafts to be used safely in swift water conditions. However, this is not meant to be limiting. Shrouds configured with selected aspects of the present disclosure may be used on non-self-bailing inflatable rafts as well, e.g., to protect the potentially-vulnerable raft surfaces from top load, submerged obstacles, etc. Many swift water rescues require that the rescue vessel be transported through wooded areas or other hazardous terrain in order to be launched. In many cases, the vessels are carried down narrow paths, or even through dense woods, that expose the vessels to a variety of hazards, such as branches, sticks, rocks, etc. If an inflatable raft (whether self-bailing or not) is equipped with a shroud configured with selected aspects of the present disclosure, the shroud may protect the raft while the raft is carried through such conditions. Indeed, it is possible to turn the raft onto its side and/or drag the raft along a trail because the shroud may protect the raft from puncture. Accordingly, shrouds configured with selected aspects of the present disclosure, which may or may not include ejection apertures 454, may be used with self-bailing and non-self-bailing inflatable rafts. Some non-self-bailing inflatable rafts have other mechanisms for bailing water from the raft, and thus may not require ejection apertures to be built into the shroud.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification, unless clearly indicated to the contrary, should be understood to mean "at least one."

The phrase "and/or," as used herein in the specification, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A nautical system comprising:

a self-bailing inflatable raft comprising:

a port inflatable tube portion;

a starboard inflatable tube portion;

a bow inflatable tube portion;

one or more fore self-bailing ports; and one or more aft self-bailing ports; and a shroud comprising:

a port side surface that is contoured to an outer periphery of the port inflatable tube portion of the self-bailing inflatable raft;

a starboard side surface that is contoured to an outer periphery of the starboard inflatable tube portion of the self-bailing inflatable raft;

a bow surface extending between the port side surface and the starboard side surface, wherein the bow surface is contoured to an outer periphery of the bow inflatable tube portion of the self-bailing inflatable raft;

a bottom surface from which at least the port side surface and starboard side surface extend upwardly; and an interior cavity bounded by the port side surface, a starboard side surface, and the bow surface, wherein the interior cavity is sized and shaped to removably receive the self-bailing inflatable raft such that the shroud obstructs the one or more fore self-bailing ports of the self-bailing inflatable raft, and wherein the shroud further defines one or more election apertures that align with one or more of the aft self-bailing ports to leave the one or more aft self-bailing ports of the self-bailing inflatable raft unobstructed.

2. The nautical system of claim 1, wherein the shroud comprises a fore section and an aft section that are permanently affixed together and that are constructed using different materials.

3. The nautical system of claim 2, wherein the fore section of the shroud is more rigid than the aft section of the shroud.

4. The nautical system of claim 3, wherein the fore section of the shroud is constructed with high density polyethylene.

5. The nautical system of claim 4, wherein the fore section of the shroud is between about $1/10^{th}$ inch and about $1/6^{th}$ inch thick.

6. The nautical system of claim 5, wherein the aft section of the shroud is constructed with a flexible para-aramid synthetic fiber.

7. The nautical system of claim 2, wherein the fore section comprises over half of the shroud extending from the bow surface.

8. The nautical system of claim 1, wherein the one or more ejection apertures are defined in the bottom surface of the shroud.

9. The nautical system of claim 1, wherein one or more anchor apertures are defined in one or more of the port side, starboard side, and bow side surfaces to provide access through the shroud to one or more anchor points of the self-bailing inflatable raft.

10. The nautical system of claim 1, wherein the shroud is constructed entirely with a flexible para-aramid synthetic fiber.

11. A nautical system comprising:

a self-bailing inflatable raft comprising:

a port inflatable tube portion;

a starboard inflatable tube portion;

a bow inflatable tube portion;

one or more fore self-bailing ports; and one or more aft self-bailing ports; and a shroud comprising:

a textile shroud comprising:

a port side portion that is sized and shaped to be wrapped at least partially around an outer periphery of the port inflatable tube portion of the self-bailing inflatable raft;

a starboard side portion that is sized and shaped to be wrapped at least partially around an outer periphery of the starboard inflatable tube portion of the self-bailing inflatable raft;

a bow portion extending between the port side portion and the starboard side portion, wherein the bow portion is sized and shaped to be wrapped at least partially around an outer periphery of the bow inflatable tube portion of the self-bailing inflatable raft; and a bottom portion extending transversely between the port side, starboard side, and bow portions and including one or more ejection apertures;

wherein upon wrapping the port side, starboard side, and bow portions at least partially around the port inflatable tube, starboard inflatable tube, and bow inflatable tube portions, respectively, the shroud obstructs one or more fore self-bailing ports of the self-bailing inflatable raft and the one or more ejection apertures align with one or more aft self-bailing ports of the self-bailing inflatable raft.

12. The nautical system of claim 11, wherein the textile shroud is constructed with a para-aramid synthetic fiber.

13. The nautical system of claim 11, wherein one or more anchor apertures are defined in the textile shroud to provide access through the textile shroud to one or more anchor points of the self-bailing inflatable raft.

14. A method of performing a swift water rescue, comprising:

providing a self-bailing inflatable raft; and securing a shroud to the self-bailing raft, wherein the shroud includes at least:

a port side surface that is contoured to an outer periphery of a port inflatable tube portion of the self-bailing inflatable raft, a starboard side surface that is contoured to an outer periphery of a starboard inflatable tube portion of the self-bailing inflatable raft, a bow surface extending between the port side surface and the starboard side surface, wherein the bow surface is contoured to an outer periphery of a bow inflatable tube portion of the self-bailing inflatable raft, a bottom surface from which at least the port side surface and starboard side surface extend upwardly, and an interior cavity bounded by the port side surface, a starboard side surface, and the bow surface, wherein the interior cavity is sized and shaped to removably receive the self-bailing inflatable raft such that the shroud obstructs one or more fore self-bailing ports of the self-bailing inflatable raft and aligns one or more election apertures with leaves one or more aft self-bailing ports of the self-bailing inflatable raft to leave the one or more aft self-bailing ports unobstructed.

15. The method of claim 14, further comprising securing a first end of a rigging line to an anchor point at the bow inflatable tube portion of the self-bailing inflatable raft.

16. The method of claim 15, further comprising launching the self-bailing inflatable raft upstream from a target for rescue while retaining hold of a second end of the rigging line.

* * * * *